US006905273B2

(12) United States Patent
Huttner et al.

(10) Patent No.: US 6,905,273 B2
(45) Date of Patent: Jun. 14, 2005

(54) PEN, WRITING UNIT AND A DEVICE FOR HOLDING A WRITING UNIT

(76) Inventors: Gerhard Huttner, Neumühle 1, 95179 Geroldsgrün (DE); Peter Pregler, Saalfelder Strasse 7, 90765 Fürth (DE)

( * ) Notice: Subject to any disclaimer, the term of this patent is extended or adjusted under 35 U.S.C. 154(b) by 189 days.

(21) Appl. No.: 10/333,083

(22) PCT Filed: Jul. 16, 2001

(86) PCT No.: PCT/EP01/08191

§ 371 (c)(1),
(2), (4) Date: Jun. 9, 2003

(87) PCT Pub. No.: WO02/06060

PCT Pub. Date: Jan. 24, 2002

(65) Prior Publication Data

US 2004/0022574 A1 Feb. 5, 2004

(30) Foreign Application Priority Data

Jul. 18, 2000 (DE) ..... 100 34 881

(51) Int. Cl.[7] ..... B43K 23/02
(52) U.S. Cl. ..... 401/131
(58) Field of Search ..... 401/34, 48, 88, 401/131, 194

(56) References Cited

U.S. PATENT DOCUMENTS 4,548,325 A * 10/1985 Hojer et al. ..... 401/131
5,445,466 A 8/1995 Mukunoki ..... 401/199
6,672,783 B1 * 1/2004 Licata et al. ..... 401/268

FOREIGN PATENT DOCUMENTS

EP 0606561 7/1994
FR 1 095 468 6/1955
FR 1 172 448 2/1959

OTHER PUBLICATIONS

PCT International Search Report, dated Dec. 23, 2001, for PCT/EP01/08191.
Derwent Abstract of EP 0606561, Derwent Accession Number 1994–226314.

* cited by examiner

*Primary Examiner*—Tuan N. Nguyen
(74) *Attorney, Agent, or Firm*—Norris McLaughlin & Marcus PA

(57) ABSTRACT

The invention relates to a pen comprising a first casing (32) and a writing unit (12), which is inserted into said first casing. According to the invention, the pen comprises the following: a first stop (24, 42), which is coupled to the writing unit and acts in a peripheral direction about the longitudinal axis (L) of said writing unit; a second stop, which is coupled to the first casing (32), acts in a peripheral direction about the longitudinal axis and interacts with the first stop (24, 42) in a predetermined first rotational position of the writing unit with respect to the first casing, the first and second stops (24, 42, 26) abutting each other in the first predetermined rotational position; a third stop (28), which is coupled to the writing unit and acts in the longitudinal direction, in addition to a fourth stop, which is coupled to the first casing (32), acts in the longitudinal direction and interacts with the third stop (28). Said third stop (28) is configured as a guide device for the fourth stop. The fourth stop can be displaced in relation to the first casing along said guide device during the rotation of the writing unit, until the predetermined first rotational position has been attained.

18 Claims, 2 Drawing Sheets

PEN, WRITING UNIT AND A DEVICE FOR HOLDING A WRITING UNIT

Figure 1:
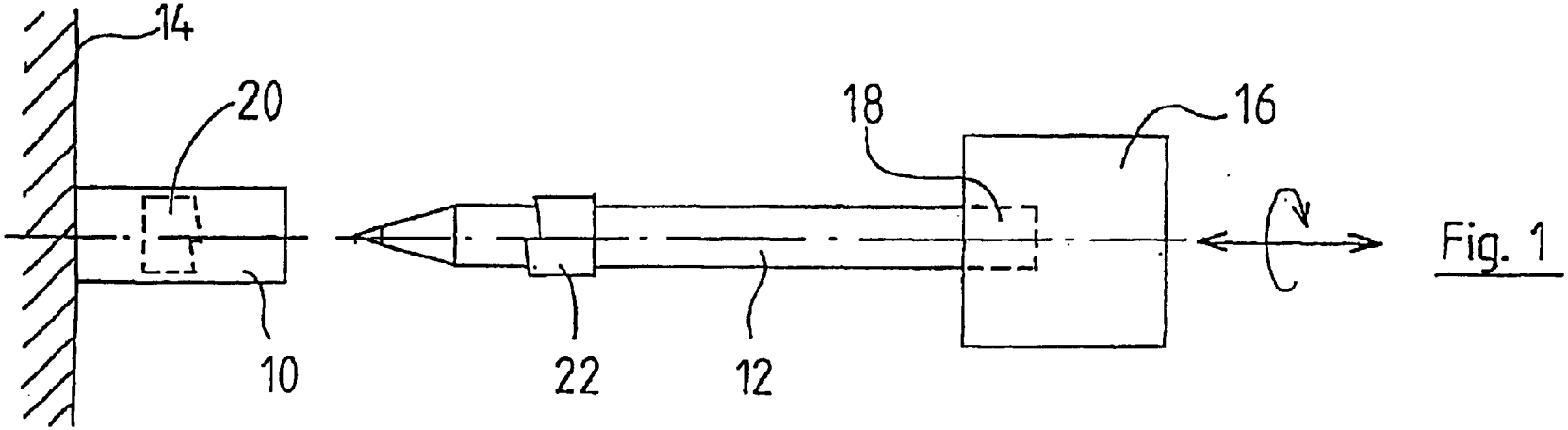

The invention concerns a pen having a first casing and a writing unit which is inserted into the first casing.

Pens of the above-indicated kind are known. In that respect the writing unit for example involves a refill or a writing fluid storage means.

In the case of the known pens there is frequently a requirement for the writing unit to be held with respect to the casing in a predetermined rotational position about the longitudinal axis of the writing unit. The reasons for such requirements can be for example that a writing tip on the writing unit is not of a rotationally symmetrical configuration or that there is information or decoration on the surface of the writing unit, in which case the information and/or the decoration is intended to be visible through a window on the pen.

Therefore, for example a nose is conventionally provided on the writing unit, which engages into a corresponding notch in the first casing, for the purposes of non-rotatably coupling the first casing to the writing unit. In that case the nose and the notch are oriented in parallel relationship with the longitudinal axis of the writing unit so that, in the situation involving engagement of the nose into the notch, axial movement of the writing unit with respect to the first casing is admittedly still possible, but not a rotational movement. In order to introduce the nose into the notch however the writing unit must already be in the desired rotational position with respect to the first casing. It is therefore difficult to automate the operation of inserting the writing unit into the first casing.

The object of the present invention is to provide a pen of the kind set forth in the opening part of this specification, in which the operation of inserting the writing unit into the first casing, including moving the writing unit into a desired rotational position with respect to the first casing, can be effected automatically.

In accordance with the invention the specified object is attained by:

- a first stop which is coupled to the writing unit and which is operative in the peripheral direction about the longitudinal axis of the writing unit,
- a second stop which is coupled to the first casing and which is operative in the peripheral direction about the longitudinal axis and which co-operates with the first stop in a predetermined first rotational position of the writing unit with respect to the first casing, wherein the first and second stops butt against each other in the first predetermined rotational position,
- a third stop which is coupled to the writing unit and which is operative in the direction of the longitudinal axis, and
- a fourth stop which is coupled to the first casing and which is operative in the longitudinal direction of the longitudinal axis and cooperates with the third stop, wherein
  - the third stop is in the form of a guide device for the fourth stop, along which the fourth stop is displaceable upon rotation of the writing unit with respect to the first casing until the predetermined first rotational position is attained.

In accordance with the invention the specified object is also attained by

- a first stop which is coupled to the writing unit and which is operative in the peripheral direction about the longitudinal axis of the writing unit,

- a second stop which is coupled to the first casing and which is operative in the peripheral direction about the longitudinal axis and which co-operates with the first stop in a predetermined first rotational position of the writing unit with respect to the first casing, wherein the first and second stops butt against each other in the first predetermined rotational position,
- a third stop which is coupled to the writing unit and which is operative in the direction of the longitudinal axis, and
- a fourth stop which is coupled to the first casing and which is operative in the direction of the longitudinal axis and co-operates with the third stop, wherein
  - the fourth stop is in the form of a guide device for the third stop, along which the third stop is displaceable upon rotation of the writing unit with respect to the first casing until the predetermined first rotational position is attained.

In the case of the pen according to the invention insertion of the writing unit into the first casing in the correct position in terms of rotational angle can be readily automated. More specifically it is only necessary (in any rotational position) for the writing unit to be inserted into the first casing to such an extent that the third and fourth stops butt against each other. As the third and/or the fourth stops is/are in the form of a guide device for the fourth and the third stop respectively, the first predetermined rotational position can readily be attained by rotation of the writing unit with respect to the first casing. As the guide device makes it possible to go from any initial rotational position into the predetermined first rotational position while maintaining the condition of contact between the third and fourth stops, the rotational position in which the writing unit is initially disposed with respect to the first casing, that is to say at the moment in time at which the writing unit is inserted into the first casing until the third and fourth stops butt against each other, is completely immaterial.

With the pen according to the invention therefore there is no need for the writing unit to be already held in the first predetermined rotational position upon being inserted into the first casing. On the contrary the first predetermined rotational position is automatically attained by simple rotational movement, with the third stop bearing against the fourth stop.

It is preferably provided in accordance with the invention that the guide device describes at least in a portion-wise manner the path of a screw coil or helix. That permits particularly uniform and resistance-free displacement of the third stop on the fourth stop or the fourth stop on the third stop.

It is possible for the writing unit in relation to the first casing to have not just one but two or more predetermined rotational positions in which it can be fitted.

Therefore the pen according to the invention preferably has at least a fifth stop which is coupled to the writing unit and which is operative in the peripheral direction about the longitudinal axis and which co-operates with the second stop in a second predetermined rotational position of the writing unit with respect to the first casing, wherein the fifth stop and the second stop butt against each other in the second predetermined rotational position.

Alternatively or additionally in accordance with the invention the pen preferably has at least a sixth stop which is coupled to the casing and which is operative in the peripheral direction about the longitudinal axis and which co-operates with the first abutment in a third predetermined rotational position of the writing unit with respect to the first casing, wherein the sixth stop and the first stop butt against each other in the third predetermined rotational position.

As already mentioned above, it can be provided in accordance with the invention that the pen has at least one viewing window through which an item of information and/or decoration on the surface of the writing unit is visible in the predetermined first rotational position, in the predetermined second rotational position and/or in the predetermined third rotational position of the writing unit with respect to the first casing. The decoration or the information may for example involve a color detail. In other words the label 'black' may be visible through the viewing window. However it may also be that it is simply an area which is colored black that is visible. In addition for example a mark may be visible through the viewing window.

In accordance with a particularly preferred embodiment of the invention the pen has a second casing which is coupled to the first casing and which serves to hold the writing unit when inserted into the first casing in the first casing. In other words for example the first casing is closed by the second casing at that end, by way of which the writing unit is inserted into the first casing. Particularly when the guide device describes the path of a screw coil or helix, the second casing can also contribute to maintaining the predetermined rotational position. More specifically the casing cannot be further rotated in a first direction of rotation by virtue of the first and second stops butting against each other. The reverse direction of rotation is however refused to it, for example in the case of the guide device being in the form of a screw coil, when the second casing prevents axial displacement of the writing unit out of the first casing.

Besides the pen the invention also concerns the writing unit which is contained therein and which is marketed individually as a consumable replacement part.

In accordance with the invention it is provided that the writing unit has at least one stop which is operative in the peripheral direction about the longitudinal axis of the writing unit and a stop which is operative in the direction of the longitudinal axis.

That arrangement provides that the writing unit according to the invention can be used together with the above-described pen according to the invention and in particular it can be automatically inserted.

Once again it is preferred in accordance with the invention that the stop which is operative in the direction of the longitudinal axis is in the form of a guide device.

In a further preferred feature in that respect the guide device describes at least in a portion-wise manner the path of a screw coil or helix.

It is further preferred in accordance with the invention that information and/or decoration is/are provided on the surface for each stop operative in the peripheral direction.

In accordance with the invention the writing unit may be for example a refill or a writing fluid storage means.

The invention not only makes it possible to automate the operation of inserting the writing unit into the first casing, but also the operation of applying information and/or a decoration to the writing unit, in which respect the information/decoration is to be visible through the viewing window which has already been mentioned above on the pen. It will be appreciated that for that purpose it is necessary for the information/decoration to be disposed in the correct rotary angle region of the writing unit.

For that purpose in accordance with the invention there is provided a device for holding a writing unit, which has at least one stop operative in the peripheral direction about a predetermined axis and at least one stop operative in the direction of the predetermined axis.

In other words the holding device for the writing unit has for example the same stops as the first casing of that pen into which the writing unit is to be later inserted. The operation of insertion into the holding device therefore takes place precisely like the operation of insertion into the first casing which has already been described in detail hereinbefore.

In this respect, the writing unit is axially displaced by a rotatable and axially displaceable tool in any rotational position of the writing unit until the stop of the writing unit, which is operative in the direction of the longitudinal axis, butts against the stop operative in the direction of the predetermined axis, on the holding device. In that case the writing unit is held by the tool in such a way that the longitudinal axis of the writing unit coincides with the predetermined axis.

At the latest when the two stops which are operative in the axial direction bear against each other, the writing unit is rotated by means of the tool until the stop which is provided on the writing unit and which is operative in the peripheral direction bears against the stop which is also operative in the peripheral direction, on the holding device. When that is the case the rotary movement is stopped. That stopping effect can be implemented for example by a torque limiter (slipping clutch) on the tool.

It will be appreciated that it is possible for the stop which is provided on the writing unit and which is operative in the direction of the longitudinal axis of the writing unit to be in the form of a guide device. It is however preferred in accordance with the invention in addition that the stop which is operative in the direction of the predetermined axis on the holding device is in the form of a guide device.

In this case in a preferred feature in accordance with the invention the guide device describes at least in a portion-wise manner the path of a screw coil or helix. As already stated above that permits particularly uniform and almost resistance-free rotation-of the writing unit with respect to the holding device until the stops which are operative in the peripheral direction butt against each other, that is to say until the predetermined rotational position is reached.

As already stated above the predetermined axis of the holding device should coincide with the longitudinal axis of a writing unit held in the holding device.

Figure 2:
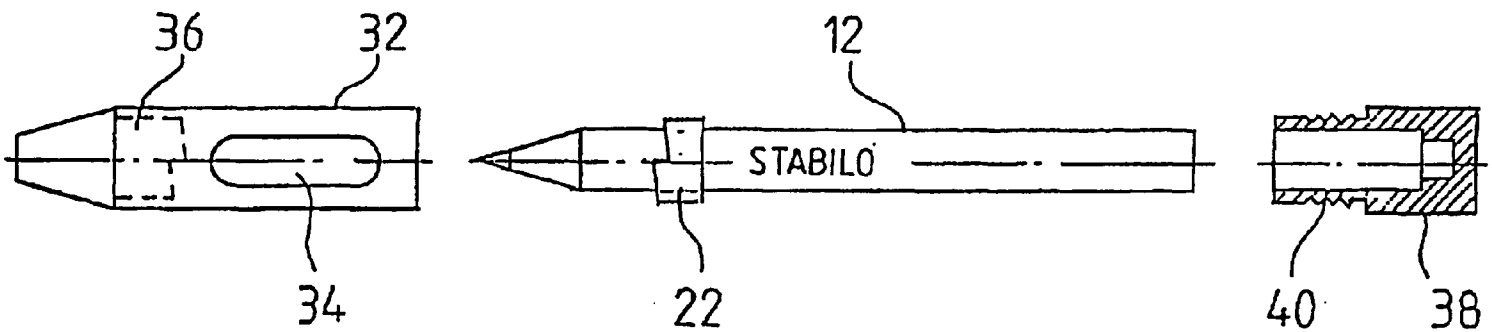
Figure 3:
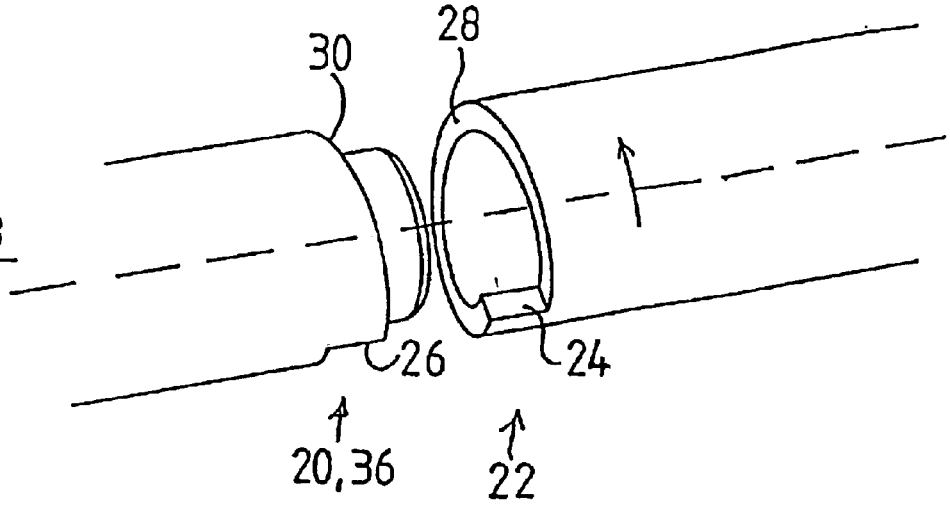
Figure 4:
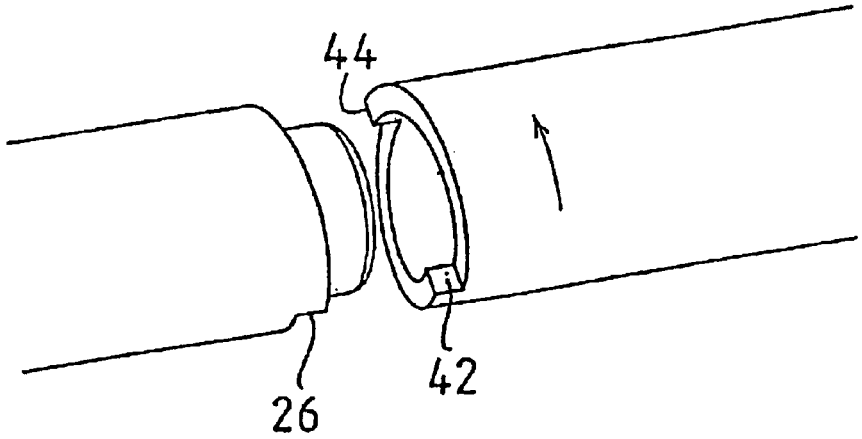
Figure 5:
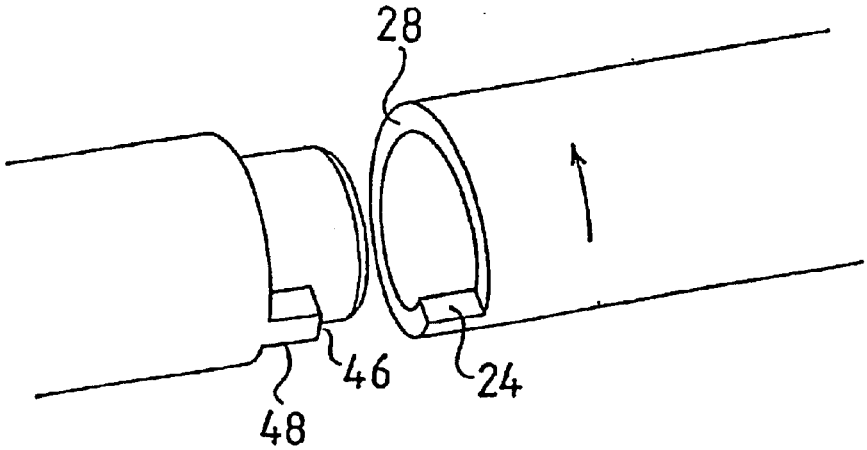

The invention is described in greater detail hereinafter by means of preferred embodiments with reference to the accompanying drawing in which:

FIG. 1 diagrammatically shows a device for holding a refill for the purposes of printing thereon in accordance with an embodiment of the invention, FIG. 2 is a diagrammatic exploded view of a pen according to an embodiment of the invention, and FIGS. 3 through 5 show enlarged details of FIGS. 1 and 2.

In FIG. 1 reference 10 denotes a device for holding a refill 12 for the purposes of printing thereon. The holding device 10 is fixed to a stationary mounting 14. It is tubular and is of such a dimension that the refill 12 can be inserted in FIG. 1 from right to left into the interior of the holding device 10. A tool 16 which is only diagrammatically shown in the drawing serves for that purpose. The tool 16 has a receiving means 18 in the form of a blind hole. In this case the receiving means 18 is so dimensioned that the end of the refill, which is shown at the right in FIG. 1, can be inserted therein, forming a frictional engagement.

The holding device 10 has a positioning aid 20. The refill 12 has a positioning aid 22. The positioning aids 20 and 22 are shown on an enlarged scale in FIG. 3.

The positioning aid 22 has a stop 24 which is in the form of a step and which is operative in the peripheral direction about the longitudinal axis L. In the same manner the positioning aid 20 has a stop 26 which is operative in the peripheral direction. In addition provided on the positioning aid 22 is a stop 28 which is operative in the direction of the longitudinal axis L and which describes the path of a screw coil. A corresponding stop 30 in the form of a screw coil is also provided at the positioning aid 20.

If printing is to be applied to the refill 12 shown in FIG. 1, the refill is fitted into the opening 18 in the tool 16, as shown in FIG. 1. The tool 16 is caused to rotate about the longitudinal axis L of the refill 12. The tool 16 with the refill 12 held thereto is also moved in FIG. 1 towards the left and thus into the holding device 10, more specifically until the stop 28 bears against the stop 30. Even after the stops bear against each other the tool 16 still continues to apply pressure in a direction towards the holding device 10. As the stop 28 slides along the stop 30 as a result of the rotation of the tool 16 and therewith the refill 12 the refill 12 will gradually move further towards the left and thus into the holding device 10, more specifically until the stop 24 butts against the stop 26. The refill 12 can now no longer rotate any further. The rotational drive of the tool 16 however does not have to be switched off. On the contrary, the frictional engagement within the recess 18 is so selected that the tool 16 can further rotate, when the refill 12 is stopped. The frictional engagement thus forms a slipping clutch.

As the refill 12 is now in a defined rotational position with respect to the holding device 10 by virtue of the stop 20 butting against the stop 28, the refill 12 can be printed upon at a predetermined location in the direction of rotation. For that purpose, a printing tool (not shown in the Figure) is moved against the refill 12.

FIG. 2 shows the refill 12 which has been printed upon with the mark STABILO and a casing 32 with a viewing window 34 through which the mark STABILO is visible when the refill 12 is fitted into the casing 32 in a predetermined rotational position. In order to guarantee the correct rotational position the refill 12 also has a positioning aid 36 which in the illustrated embodiment corresponds to the positioning aid 20. After the operation of being printed with the mark STABILO therefore the refill 12 can be automatically inserted into the casing 32 by the tool 16 or a similar tool, in which case it will be appreciated that the casing 32 then has to be held in a suitable manner. In that respect the respective rotational position of the casing 32 in the holding arrangement plays no part. More specifically, the refill 12 is always inserted in the correct rotational position with respect to the casing 32 by the tool 16 because the positioning aids 22 and 36, just like the positioning aids 22 and 60, co-operate in such a way that the refill 12 is automatically correctly positioned. For that purpose, it is again only necessary for the tool to be moved from right to left in FIG. 2 and rotated.

After the operation of automatically inserting the refill 12 into the casing 32 a casing 38 with a male screwthread 40 is screwed into a female screwthread (not shown in the Figure) on the casing 32. In the screwed-in condition the refill 12 bears with its rear end against the closed rear end of the casing 38.

Screwing the casing 38 to the casing 32 provides that the refill 12 is definitively moved into the predetermined rotational position or is held in the predetermined rotational position, in which respect the predetermined rotational position is so selected that the mark STABILO appears in the window 34.

The pitch of the screwthread 40 is at most of the same value as the pitch of the screw coils 28 and 30, and is rather somewhat shallower, so that forcible screwing of the two casings 38 and 32 is avoided in any case. In other words: the screwthread 40 may only engage when the refill 12 has reached the predetermined rotational position within the casing 32.

FIGS. 4 and 5 show alternative embodiments of positioning aids. In this respect the embodiment of FIG. 4 differs from that shown in FIG. 3 in that there are two stops 42 and 40 operative in the peripheral direction about the longitudinal axis. This means that the refill 12 can assume two different rotational positions which in this example are displaced through 180° relative to each other. Such a configuration is meaningful in particular when there are two viewing windows and two printing items.

When the positioning aids are of the design configuration shown in FIG. 5 the arrangement does not involve two screw coils sliding against each other, but rather a stop 46 of comparatively small area, which is operative in the direction of the longitudinal axis L, slides on the screw coil 28 until a stop 48 operative in the peripheral direction butts against its counterpart stop 24.

It will be appreciated that the situations shown in FIGS. 4 and 5 may also be selected to be precisely the reverse. In other words, that would then provide for example that the two stops 42 and 44 are provided on the holding device 10 and/or on the casing 32. In addition for example the stops 46 and 48 may also be provided on the refill 12 which then cooperates with the positioning aid 20 or 36 on the holding device 10 or the casing 32 respectively.

As the foregoing description shows the invention not only permits automatic fitment of the holding device 10 with the refill 12 for printing thereon with a defined rotary angle, but also subsequent automatic insertion of the refill 12 into the casing 32, once again with a predetermined orientation in respect of rotary angle of the refill 12 with respect to the casing 32 so that the printing STABILO appears precisely in the viewing window 34.

The features of the invention disclosed in the foregoing description, the claims and the drawing may be essential both individually and also in any combinations for implementing the invention in its various embodiments.

What is claimed is:

1. A pen comprising a first casing and a writing unit which is inserted into the first casing in the form of a refill or a writing fluid storage means characterised by a first stop which is coupled to the writing unit and which is operative in the peripheral direction about the longitudinal axis L of the writing unit, a second stop which is coupled to the first casing and which is operative in the peripheral direction about the longitudinal axis L and which co-operates with the first stop in a predetermined first rotational position of the writing unit with respect to the first casing, wherein the first and second stops butt against each other in the predetermined first rotational position, a third stop which is coupled to the writing unit and which is operative in the direction of the longitudinal axis L, and a fourth stop which is coupled to the first casing and which is operative in the direction of the longitudinal axis L and co-operates with the third stop, wherein the third stop is in the form of a guide device for the fourth stop, along which the fourth stop is displaceable upon rotation of the writing unit with respect to the first casing until the predetermined first rotational position is attained.

2. A pen as set forth in claim 1 characterised in that the guide device describes at least in a portion-wise manner the path of a screw coil.

3. A pen as set forth in claim 1 characterised by at least a fifth stop which is coupled to the writing unit and which is operative in the peripheral direction about the longitudinal axis L and which co-operates with the second stop in a predetermined second rotational position of the writing unit with respect to the first casing, wherein the fifth stop and the second stop butt against each other in the predetermined second rotational position.

4. A pen as set forth in claim 1 characterised by at least a sixth stop which is coupled to the casing and which is operative in the peripheral direction about the longitudinal axis L and which co-operates with the first stop in a predetermined third rotational position of the writing unit with respect to the first casing, wherein the sixth stop and the first stop butt against each other in the predetermined third rotational position.

5. A pen as set forth in claim 1 characterised in that it has at least one viewing window through which an item of information and/or decoration on the surface of the writing unit is visible in the predetermined first rotational position, in the predetermined second rotational position and/or in the predetermined third rotational position of the writing unit with respect to the first casing.

6. A pen as set forth in claim 1 characterised by a second casing which is coupled to the first casing and which serves to hold the writing unit inserted into the first casing in the first casing.

7. A writing unit in the form of a refill or a writing fluid storage means, for a pen as set forth in claim 1 characterised by at least one stop operative in the peripheral direction about a longitudinal axis of the writing unit, and at least one stop operative in the direction of the longitudinal axis.

8. A writing unit as set forth in claim 7, characterised in that the stop operative in the direction of the longitudinal axis is in the form of a guide device.

9. A writing unit as set forth in claim 8 characterised in that the guide device describes at least in a portion-wise manner the path of a screw coil.

10. A writing unit as set forth in claim 7 characterised in that an item of information and/or decoration is/are provided on the surface for each stop operative in the peripheral direction.

11. A writing unit as set forth in claim 1 characterised in that it is a refill or a writing fluid storage means.

12. A device for holding a writing unit in the form of a refill or a writing fluid storage means of a writing unit as set forth in claim 7 characterised by at least one stop operative in the peripheral direction about a predetermined axis, and at least one stop operative in the direction of the predetermined axis.

13. A device for holding a writing unit in the form of a refill or a writing fluid storage means of a pen as set forth in claim 7, characterised by at least one stop operative in the peripheral direction about a predetermined axis, and at least one stop operative in the direction of the predetermined axis.

14. A device as set forth in claim 13 characterised in that the stop operative in the direction of the predetermined axis is in the form of a guide device.

15. A device as set forth in claim 14 characterised in that the guide device describes at least in a portion-wise manner the path of a screw coil.

16. A device as set forth in claim 1 characterised in that the predetermined axis coincides with the longitudinal axis L of a writing unit held by the device.

17. A pen comprising a first casing and a writing unit which is inserted into the first casing in the form of a refill or a writing fluid storage means characterised by a first stop which is coupled to the writing unit and which is operative in the peripheral direction about the longitudinal axis L of the writing unit, a second stop which is coupled to the first casing and which is operative in the peripheral direction about the longitudinal axis L and which co-operates with the first stop in a predetermined first rotational position of the writing unit with respect to the first casing, wherein the first and second stops butt against each other in the predetermined first rotational position, a third stop which is coupled to the writing unit and which is operative in the direction of the longitudinal axis L, and a fourth stop which is coupled to the first casing and which is operative in the direction of the longitudinal axis L and co-operates with the third stop, wherein the fourth stop is in the form of a guide device for the third stop, along which the third stop is displaceable upon rotation of the writing unit with respect to the first casing until the predetermined first rotational position is attained.

18. A pen as set forth in claim 2 characterised in that the guide device describes at least in a portion-wise manner the path of a screw coil.

* * * * *

UNITED STATES PATENT AND TRADEMARK OFFICE

CERTIFICATE OF CORRECTION

PATENT NO. : 6,905,273 B2
DATED : June 14, 2005
INVENTOR(S) : Gerhard Huettner et al.

It is certified that error appears in the above-identified patent and that said Letters Patent is hereby corrected as shown below:

Title page,
Item [75], Inventor, "Gerhard Huttner" should be corrected to -- Gerard Huettner --.

Column 7,
Line 35, after "longitudinal axis" insert -- L --.

Signed and Sealed this

Eighth Day of November, 2005

JON W. DUDAS
*Director of the United States Patent and Trademark Office*